US012635770B2

(12) United States Patent
Fildan et al.

(10) Patent No.: US 12,635,770 B2
(45) Date of Patent: May 26, 2026

(54) REVERSIBLE GARMENT CLOSURE

(71) Applicants: Gerhard Fildan, Vienna (AT); Karl Wanzenböck, Teesdorf (AT)

(72) Inventors: Gerhard Fildan, Vienna (AT); Karl Wanzenböck, Teesdorf (AT)

(73) Assignee: DUBROSKY & TRACY PATENT SERVICE CORP., Central (HK)

( * ) Notice: Subject to any disclaimer, the term of this patent is extended or adjusted under 35 U.S.C. 154(b) by 0 days.

(21) Appl. No.: 18/826,789

(22) Filed: Sep. 6, 2024

(65) Prior Publication Data

US 2026/0069000 A1 Mar. 12, 2026

(51) Int. Cl.
*A41F 1/00* (2006.01)
*A44B 13/00* (2006.01)

(52) U.S. Cl.
CPC ..... *A44B 13/00* (2013.01)

(58) Field of Classification Search
CPC .... A41F 1/00; A41F 1/006; A41F 1/04; A41F 1/06; A41F 1/08; Y10T 24/45037; Y10T 24/45052; Y10T 24/45058; Y10T 24/45152; Y10T 24/45937
See application file for complete search history.

(56) References Cited

U.S. PATENT DOCUMENTS 236,322 A * 1/1881 Name not available . A41F 1/04 450/139
1,075,601 A * 10/1913 Name not available ..... A44B 17/0029 24/697.2
4,568,206 A * 2/1986 Imazaike ..... F16C 33/3875 384/530
D350,712 S * 9/1994 D'Ambrosio ..... D11/218
D356,525 S * 3/1995 Fildan ..... D11/218
5,485,658 A * 1/1996 Fildan ..... A41F 1/006 24/666
D387,014 S * 12/1997 Matoba ..... D11/218
6,298,527 B1 * 10/2001 Fildan ..... A44B 17/0029 450/82

(Continued)

FOREIGN PATENT DOCUMENTS

EP 1101418 A2 5/2001
EP 1101418 B1 * 9/2004 ..... A44B 13/0023

OTHER PUBLICATIONS

Primark: Our Adaptive Underwear Collection; https://www.primark.com/en-GB/a/inspiration/fashion-trends/our-adaptive-range.

*Primary Examiner* — Jason W San
*Assistant Examiner* — Anna S Rashid
(74) *Attorney, Agent, or Firm* — Kintner IP, LLC; Mary Frances Ludwig

(57) ABSTRACT

A garment closure provides ease of operation for wearers with physical disabilities, high tensile strength, and is reversible, adding to functional and aesthetic versatility. The closure includes a two parts, each including a fastener piece with a rear face, a hook extending rearwardly from the rear face, and a recess in the rear face located forwardly of the hook. The hooks of the parts are engageable with each other, with the roof of the hook of one part at least partially located within the recess of the other part, thereby securing the two garment pieces together. The design allows for a secure and reliable closure mechanism that is easy to use and durable for various types of garments.

18 Claims, 11 Drawing Sheets

(56) References Cited

U.S. PATENT DOCUMENTS 6,321,419 B1 * 11/2001 Fildan ..... A44B 17/0029 450/82
6,353,978 B1 * 3/2002 Kawahara ..... A44B 17/0035 24/114.4
6,401,308 B1 * 6/2002 Kawahara ..... A44B 17/0058 24/584.1
D475,653 S * 6/2003 Fildan ..... D11/216
7,395,584 B2 * 7/2008 Khalifa ..... H01R 24/84 439/288
8,230,559 B2 * 7/2012 Fildan ..... H01F 7/0263 24/669
8,239,970 B2 * 8/2012 Ikeda ..... A42B 3/127 24/114.4
8,407,868 B2 * 4/2013 Chung ..... A44B 13/007 24/713.6
8,484,813 B2 * 7/2013 Taniguchi ..... A44B 17/0029 24/586.11
8,505,174 B2 * 8/2013 Fildan ..... A41F 1/002 24/669
8,935,835 B2 * 1/2015 Fildan ..... H01F 7/0263 24/669
D740,168 S * 10/2015 Fildan ..... D11/218
9,578,911 B2 * 2/2017 Fildan ..... A41F 1/006
9,642,407 B2 * 5/2017 Fildan ..... A41F 1/006
9,721,712 B2 * 8/2017 Provencher ..... A45C 13/1069
10,357,084 B2 * 7/2019 Yu ..... E04H 15/64
10,681,962 B1 * 6/2020 Fildan ..... A44B 17/007
10,701,998 B2 * 7/2020 Fildan ..... A41F 1/04
10,920,366 B1 * 2/2021 Mulholland ..... D06F 95/008
11,903,458 B1 * 2/2024 Fildan ..... A44B 17/0041
D1,061,330 S * 2/2025 Fildan ..... D11/208
12,342,889 B2 * 7/2025 Yip ..... A41F 1/002
2012/0102686 A1 * 5/2012 Wanzenboeck ..... A41F 1/006 24/591.1
2015/0135486 A1 * 5/2015 Fiedler ..... A44B 11/26 24/303
2018/0132570 A1 * 5/2018 Chen ..... A41F 1/002
2018/0146730 A1 * 5/2018 Fildan ..... A41F 1/006
2021/0186133 A1 * 6/2021 Fiedler ..... A41F 1/002
2021/0186134 A1 * 6/2021 Fiedler ..... A44B 13/0052
2022/0304427 A1 * 9/2022 Fildan ..... A44B 11/22
2023/0000215 A1 * 1/2023 Fung ..... A44B 13/0029
2023/0126308 A1 * 4/2023 Casillas ..... A41C 3/0028 450/36
2024/0090605 A1 * 3/2024 Yip ..... A41F 1/006
2025/0082055 A1 * 3/2025 Clayton ..... A41D 1/215
2025/0213011 A1 * 7/2025 Rasmussen ..... A44B 11/28

* cited by examiner

REVERSIBLE GARMENT CLOSURE

CROSS REFERENCE TO RELATED APPLICATION

None

TECHNICAL FIELD

The present disclosure pertains generally to closures, and more particularly to a reversible garment closure including two parts each having a hook that is engageable with a hook of the other part.

BACKGROUND OF THE INVENTION

Garments such as brassieres, swimwear, and the like commonly include hook and eye type closures, having multiple small eyes which engage an equal number of small hooks, typically behind the back of the wearer. Such closures are difficult to operate for those who are full figured or have a physical disability such as arthritis, and may be impossible to operate for some, such as those who have lost the use of an arm or hand. For example, a wearer may have difficulty engaging a metal hook, which is commonly offset from the garment fabric, with a relatively flat, low lying eye. In addition, exposed hooks (which are often metal) may come in contact with the wearer's body, causing discomfort, or may catch on and damage garments.

While some prior art closures, such as front closures, are designed for simpler operation, the parts of such closures may still be difficult to align, e.g., with single-handed operation. In other cases, such closures do not provide adequate support for a garment for full figured wearers, athletic use, or other high stress applications.

There is therefore a need in the art for a closure that overcomes these shortcomings.

BRIEF SUMMARY OF THE EMBODIMENTS

The reversible garment closure disclosed herein provides ease of operation, especially for wearers with a physical disability, high tensile strength, and the capability to be reversed, thereby increasing functionality and enabling use with alternative reversible looks for a garment. First and second parts of the closure each include a hook engageable with the hook of the other part. Examples of the closure provide multiple options for connection to a garment. In some cases, the fastener piece including the hook may be made of a plastic material (e.g., polyamide (PA)) and may be connected to a fabric including the same or a similar plastic material (e.g., microfiber PA). In this manner, the closure assembly is recyclable and environmentally sustainable.

According to one or more examples of a garment closure for securing two pieces of a garment together, the closure includes: a first part configured to be mounted on one of the two pieces and a second part configured to be mounted on the other of the two pieces; each of the first part and the second part including: a fastener piece having a rear face; a hook extending rearwardly from the rear face and having a roof; and a recess in the rear face, the recess located forwardly of the hook and shaped to receive the roof; and wherein the hook of the first part is engageable with the hook of the second part with the roof of the hook of the first part at least partially located within the recess of the second part and the roof of the hook of the second part at least partially located within the recess of the first part, thereby securing the two pieces of the garment together.

According to one or more examples of the closure, the fastener piece of each of the first part and the second part are identical, or substantially identical. This feature improves ease of manufacture and reduces costs, as a single part may be used for both elements of the closure (in contrast to common hook and eye, or male and female, fastener pairs).

According to one or more examples of the closure, the hook includes a sidewall at least partially surrounding the recess.

According to one or more examples of the closure, the rear face of each of the first part and the second part has a weld region including a plurality of protrusions distributed throughout the weld region.

According to one or more examples, the closure includes a fabric layer ultrasonically welded to the weld region.

According to one or more examples, the closure has a tensile strength of at least 30 pounds.

According to one or more examples of the closure, the first part includes a plurality of hooks spaced apart in a direction of garment adjustment; and the hook of the second part is alternately engageable with each of the plurality of hooks to adjust a size of the garment. In some examples, the plurality of hooks are separated by regions consisting of one or more fabric layers. This feature improves flexibility of the closure.

According to one or more examples, the closure includes an anchor extending from the rear face adjacent the hook and sized to extend beyond both the hook and the recess.

According to one or more examples of the closure, each hook of the first part and the second part includes a lip on a front side of the hook, the lip extending perpendicular to a direction of engagement.

According to one or more examples of the closure, each of the hooks has an interior end that is tapered rearwardly.

According to one or more examples of the closure, the fastener piece of each of the first part and the second part has an exterior side including a loop configured for securing one of the two pieces of the garment thereto.

According to one or more examples of the closure, the fastener piece of each of the first part and the second part has an exterior side including a flange configured for securing one of the two pieces of the garment thereto.

According to one or more examples of the closure, each hook is surrounded by a body and formed unitarily therewith, the body having a waist having a waist thickness that is less than a body thickness.

According to one or more examples, a closure, wherein the waist thickness is less than one half of the body thickness.

According to one or more examples, a closure, wherein the body is unitarily formed with a plurality of hooks and has a plurality of waists, each waist located adjacent one of the plurality of hooks.

Further provided is a garment including the garment closure of any of the embodiments disclosed herein.

These and other aspects of the embodiments will be better appreciated and understood when considered in conjunction with the following description and the accompanying drawings. The following description, while indicating various embodiments and details thereof, is given by way of illustration and not of limitation. Many substitutions, modifications, additions, or rearrangements may be made within the scope of the embodiments, and the embodiments may include all such substitutions, modifications, additions, or rearrangements.

BRIEF DESCRIPTION OF THE DRAWINGS

Non-limiting and non-exhaustive embodiments of the garment closure are described with reference to the following figures, wherein like reference numerals refer to like parts throughout the various views unless otherwise specified.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments. Also, common but well-understood elements that are useful or necessary in a commercially feasible embodiment are often not depicted in order to facilitate a less obstructed view of these various embodiments.

DETAILED DESCRIPTION OF THE INVENTION

The detailed description describes non-limiting exemplary embodiments. Any individual features may be combined with other features as required by different applications for at least the benefits described herein. As used herein, the term "about" means plus or minus 10% of a given value unless specifically indicated otherwise. As used herein, the terms "substantially" or "substantially the same" mean that two items are at least 90% the same; for example, a feature described as "substantially parallel" may be parallel to within 90%, an element described as "substantially circular" may be circular to within 90%, and so on.

As used herein, the conjunction "or" is to be construed inclusively (e.g., "A or B" would be interpreted as "A, or B, or both A and B"; e.g., "A, B, or C" would be interpreted as "A; or B; or C; or any two of A, B, and C; or all three of A, B, and C").

As used herein, disclosure of a singular element is also a disclosure of a plural element and vice versa unless otherwise noted.

In the present disclosure, many features are described as being optional, e.g. through the use of the verb "may" or the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features, or with all three of the three possible features.

Figure 1:
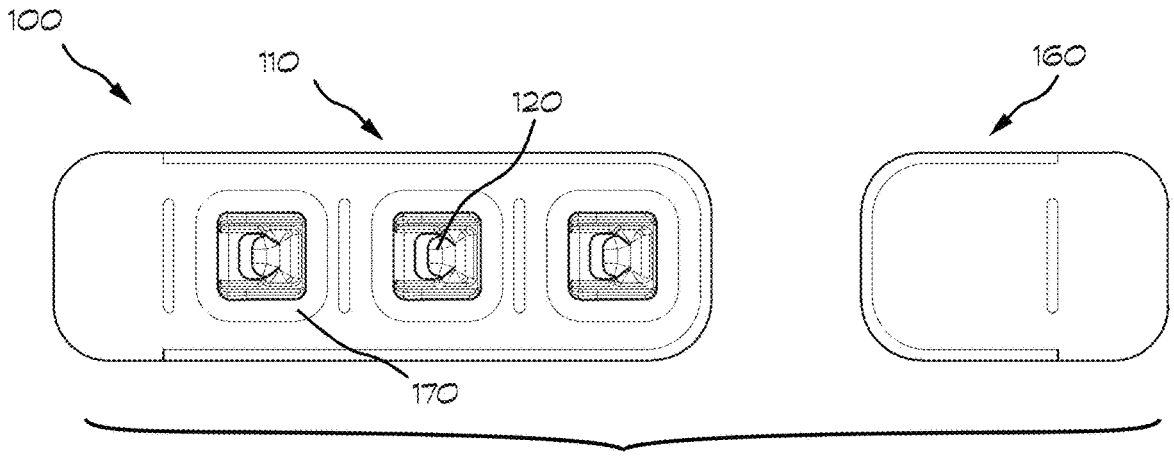
FIG. 1 is a front elevation view of an exemplary garment closure in an open position.
Figure 2:
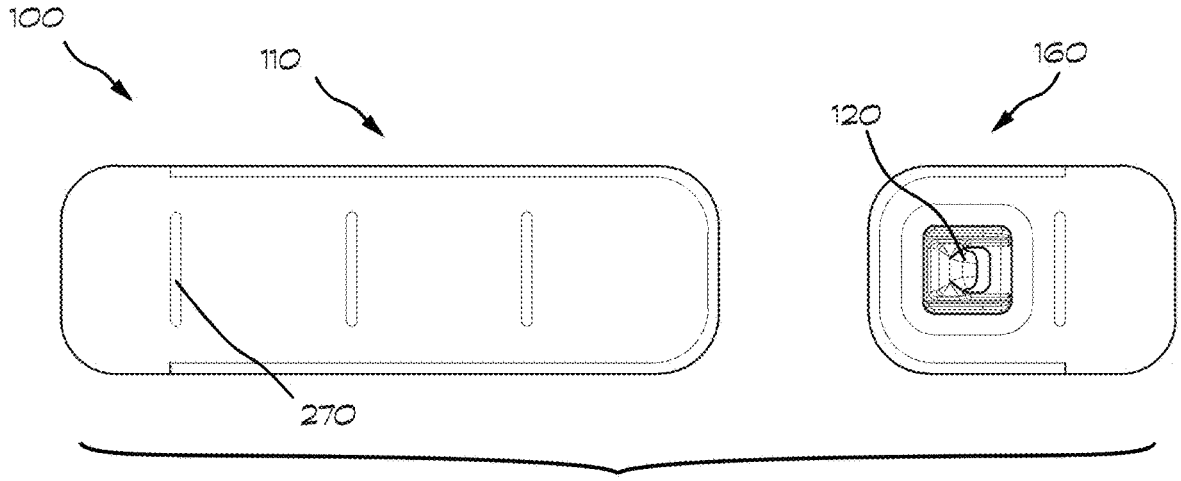
FIG. 2 is a rear elevation view of the closure of FIG. 1 in an open position.
Figure 3:
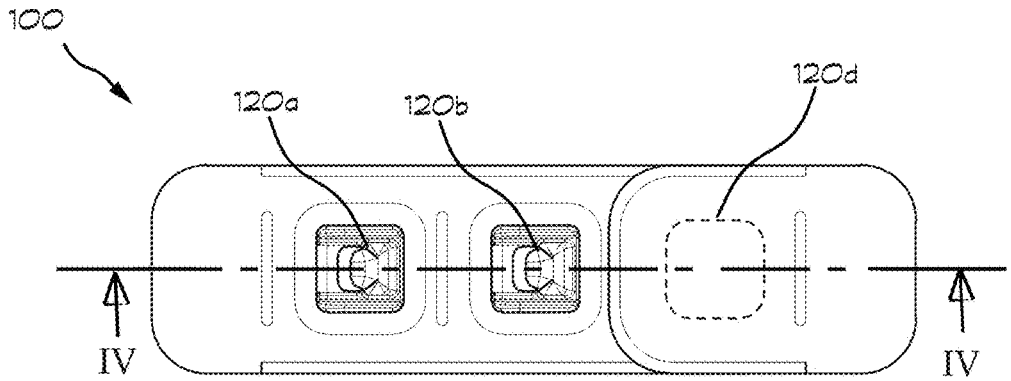
FIG. 3 is a front elevation view of the closure of FIG. 1 in a closed position.

FIGS. 1-2 are front and rear elevation views, respectively, of an exemplary garment closure 100 in an open position. FIG. 3 is a front elevation view of the closure 100 in a closed position. The garment closure 100 includes a first part 110 and a second part 160 that are engageable with one another. Each of the first part 110 and the second part 160 are configured to be mounted on separate pieces of a garment, or similar article, for securing the pieces together. Each of the first part 110 and the second part 160 have at least one hook 120 and each hook of the first part 110 is engageable with the hook of the second part 160 to close the closure. In the illustrated example, the first part 110 includes three hooks 120 and the second part 160 includes one hook 120. The hook 120*d* (see FIG. 3) of the second part 160 is alternately engageable with each of the plurality of hooks 120*a*-120*c* of the first part 110 (see hook 120*c* of FIG. 4); by engaging hook 120*d* with different hooks 120*a*-120*c* the size of the garment 400 (see FIG. 4) may be adjusted.

As used with reference to the first part and second part, the terms "front", "forward", or similar refer to a direction facing away from the other part when the closure is closed (this direction may face toward or away from the body of the wearer depending on the part being referenced and the direction in which the closure is worn). Similarly, the terms "rear", "rearward", or similar refer to a direction facing toward the other part when the closure is closed. Thus, when the closure is closed, the rear face of the first part will be oriented to face the rear face of the second part. As used with reference to a garment closure including a first part and second part, the terms "front", "forward", or similar refer to a direction facing away from the body of the wearer, and the terms "rear", "rearward", or similar refer to a direction facing toward the body of the wearer. Thus, and as see in FIG. 1, a front view of the garment closure will include a front view of either of the first part and the second part and at least a partial rear view of the other of the first part and the second part.

Figure 4:
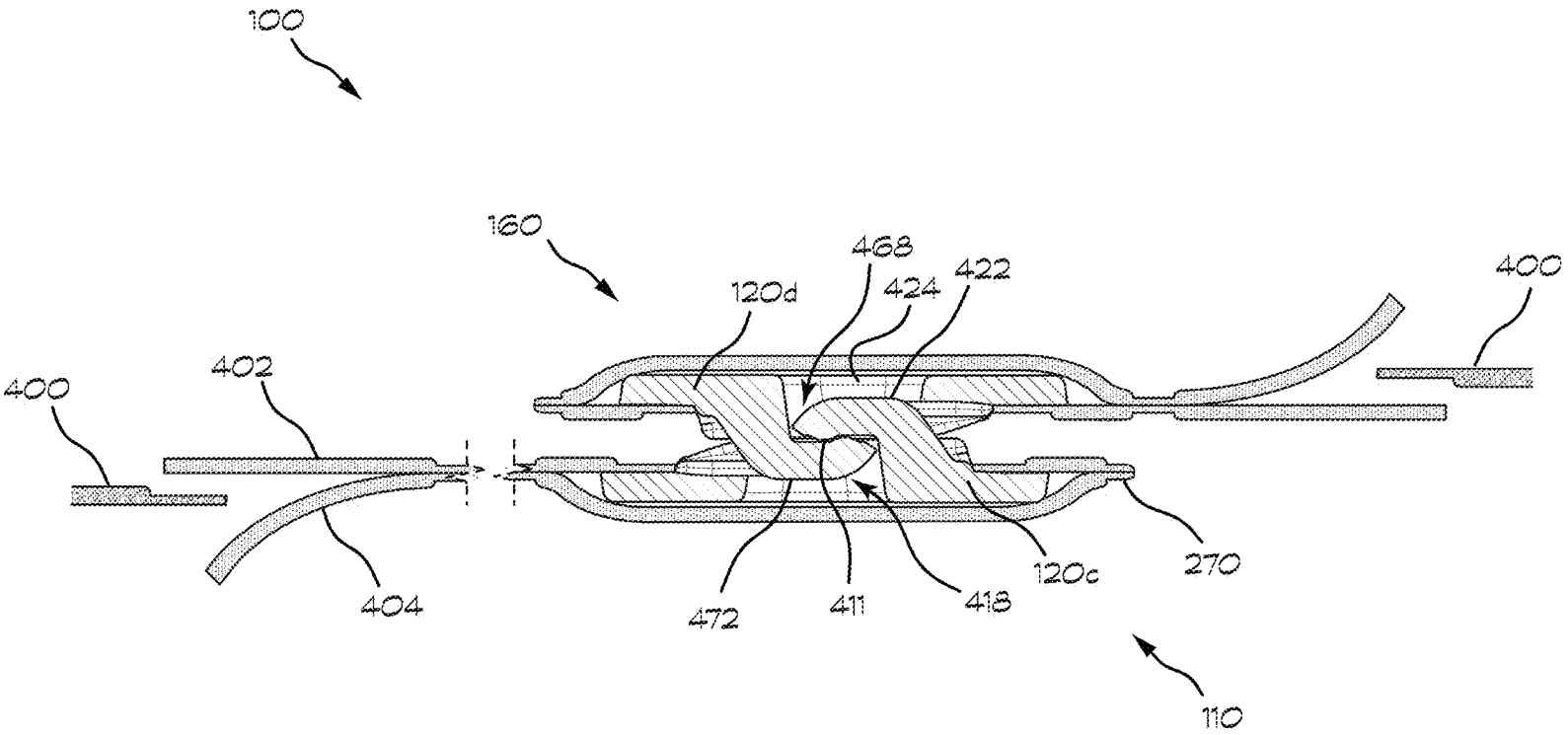
FIG. 4 is an enlarged scale cross-sectional view along the line IV-IV of FIG. 3.
Figure 5:
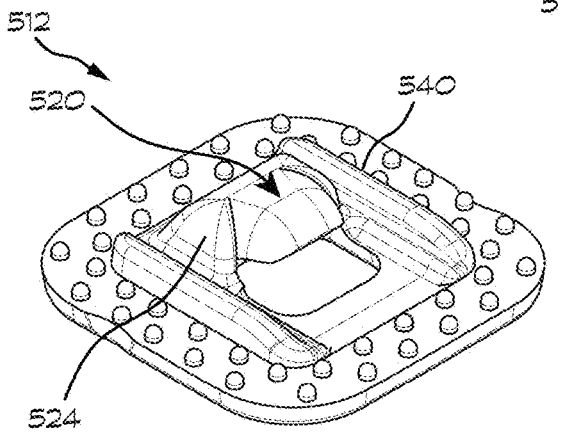
FIG. 5 is a perspective view of an exemplary fastener piece for a garment closure.
Figure 6:
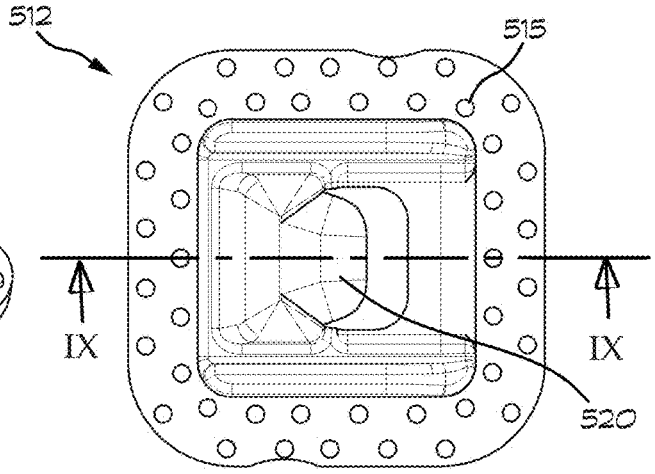
FIG. 6 is a rear elevation view of the first part of FIG. 5.
Figure 8:
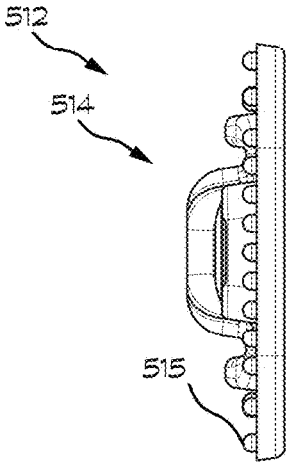
FIG. 8 is a first side view of the first part of FIG. 5.
Figure 7:
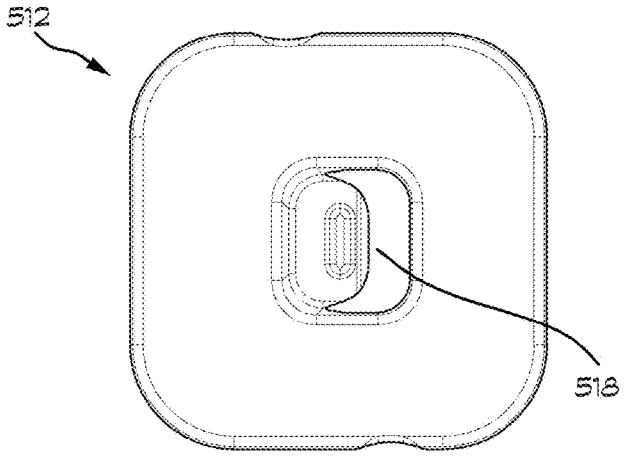
FIG. 7 is a front elevation view of the first part of FIG. 5.

FIG. 4 is an enlarged scale cross-sectional view along the line IV-IV of FIG. 3. The first part 110 may include a first strip 402, which may be fabric or similar. One or more fastener pieces (each including a hook, e.g. hook 120*c*) may be mounted to the first strip 402, such as by ultrasonic welding within a weld region 170 (see FIG. 1). In this manner, the first strip 402 may substantially surround each of the hooks 120. This production method provides convenience and low cost, as the first strip 402 may be cut to include a desired number of the hooks 120, and then sewn, welded, or otherwise joined to a garment. A second strip 404, which may be fabric or similar, may be connected to the first strip 402 (e.g., by ultrasonic welding along the weld lines 270, see also FIG. 2). The first strip 402 and the second strip 404 may form a flap with a gap therebetween suitable for connecting the first part 110 to another material, such as a first piece of a garment 400 (e.g., by sewing or welding the garment 400 between the first strip 402 and the second strip 404). The second part 160 may be constructed in a similar manner and may be connected to a second piece of the garment 400. This example closure may be extremely thin, providing enhanced comfort for the wearer. When engaged, the closure may, for example, have a thickness in the range of 3.5-4.5 mm. In particular, the closure may have a thickness of 3.8 mm.

Figure 9:
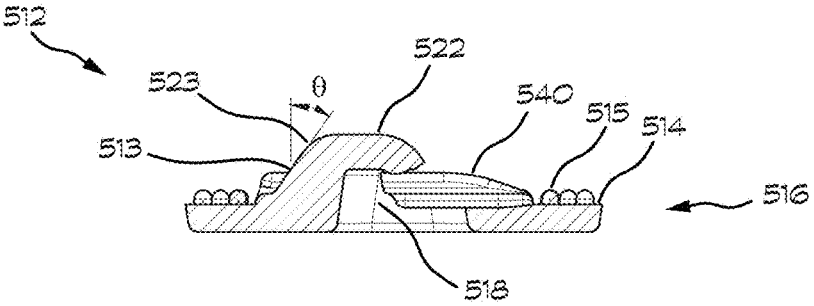
FIG. 9 is a cross-sectional view along the line IX-IX of FIG. 6.

FIGS. 5-8 are perspective, rear elevation, front elevation, and first side views, respectively, of an exemplary fastener piece 512 for a garment closure. FIG. 9 is a cross-sectional view along the line IX-IX of FIG. 6. The fastener piece 512 has a hook 520 extending rearwardly from a rear face 514. The hook 520 may extend rearwardly beyond the rear face 514, as may be seen in FIG. 8. The hook 520 may have a roof 522 (see FIG. 9) that extends toward an exterior side 516 of the fastener piece 512. Rear face 514 has a recess 518 located forward of the hook 520. The recess 518 may be shaped to receive the roof 522 of a hook of a corresponding fastener piece (e.g., the roof of a hook on the second part). The recess 518 may also, or instead, be at least partially surrounded by a sidewall 524 of the hook 520.

The sidewall 524 may guide the engaging hook into the recess, and resist inadvertent disengagement of the hook from the recess. In addition, the sidewall 524 stiffens the hook and resists deformation of the roof of the hook.

The hook 520 may have an interior end 513 that is tapered rearwardly, such as at an angle, θ, of about 35 degrees, for example. This taper of the interior end 513 may assist in engagement of the hook 520 with a recess of a corresponding second part (see also FIG. 4). In addition, or instead, the roof 522 may have an interior edge 523 that is rounded to further aid in engagement.

The fastener piece 512 may include a weld region on a rear face 514, and the weld region may include a plurality of protrusions 515 distributed throughout the weld region and configured for ultrasonic welding of, for example, a fabric thereto (for example, as described with reference to FIG. 4). The weld region may substantially surround, collectively, the hook 520 and the recess 518.

The fastener piece 512 may include one or more anchors 540 extending from the rear face (two anchors in the shown example). Each anchor 540 may be located adjacent the hook 520, and may be sized to extend beyond the hook 520 on one end and to extend beyond the recess 518 on the other end. When the fastener piece 512 is mounted to a piece of fabric, e.g., through an opening in the fabric, the anchor functions to align the fastener piece 512 to the opening with the welding region on the opposite side of the opening. The anchors may extend substantially parallel to the direction of the hook, e.g., the direction of engagement of the closure.

The fastener piece 512 may preferably made out of a plastic material, such as polyamide (PA). In some cases, the fastener piece 512 may be mounted on a fabric including the same or a similar plastic material (e.g., microfiber PA), making the entire assembly recyclable.

Referring again to FIG. 4, it can be seen how a first hook 120*c* of the first part 110 is engageable with a second hook 120*d* of the second part 160. When engaged, the first roof 422 of the first hook 120*c* is at least partially located within a second recess 468 of the second part 160. Similarly, the second roof 472 of the second hook 120*d* is at least partially located within a first recess 418 of the first part 110. It is to be understood that the same type of engagement applies, mutatis mutandis, to any other hooks of the first and second parts. This engagement may be achieved by sliding the hook of the first part toward the hook of the second part until each hook is positioned in the recess of the opposing part. In this manner, the closure may be used to secure the two pieces of the garment 400 together.

Figure 10A:
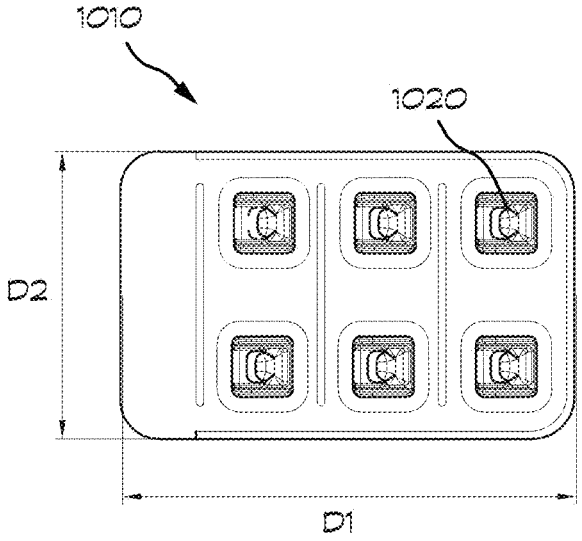
FIG. 10A is a rear elevation view of a first part of an exemplary closure.
Figure 10B:
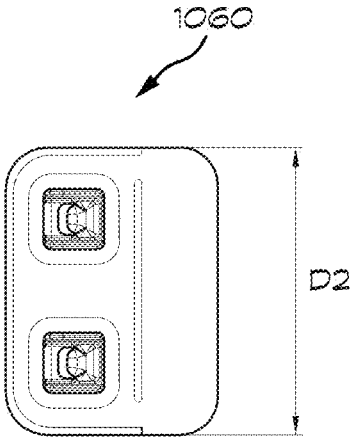
FIG. 10B is a rear elevation view of a second part of the exemplary closure.

FIGS. 10A and 10B are rear elevation views of a first part 1010 and a second part 1060, respectively, of another exemplary closure. The first part 1010 and the second part 1060 may have many features in common with other embodiments described herein, such as the first part 110 and the second part 160 of FIG. 1. Similar to first part 110, the first part 1010 may have a plurality of hooks spaced apart in a direction of garment adjustment, D1 (three of hook 120 shown spaced apart along direction D1). In addition, or instead, each of the first part 1010 and the second part 1060 may have a plurality of hooks spaced apart in a direction, D2, that is substantially orthogonal to the direction of garment adjustment, D1. In the present example, two of hook 1020 are spaced apart along direction D2.

Figure 11A:
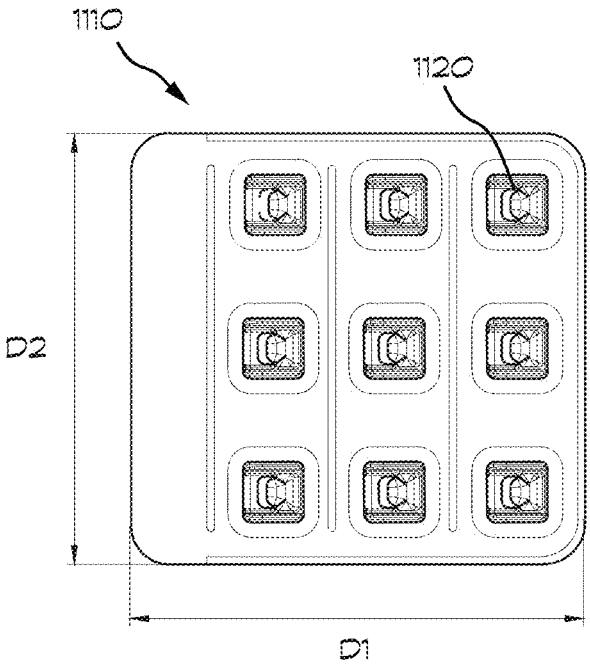
FIG. 11A is a rear elevation view of a first part of an exemplary closure.
Figure 11B:
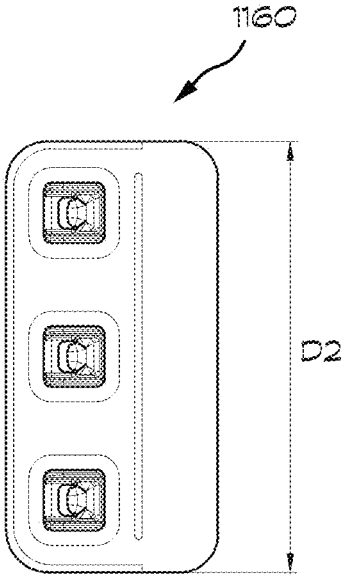
FIG. 11B is a rear elevation view of a second part of the exemplary closure.

FIGS. 11A and 11B are rear elevation views of a first part 1110 and a second part 1160, respectively, of another exemplary closure. Similar to the first part 1010 and second part 1060 of FIG. 10, the first part 1110 and second part 1160 may include a plurality of hooks spaced apart in a direction, D2, that is substantially orthogonal to the direction of garment adjustment, D1. In the present example, three of hook 1120 are spaced apart along direction D2. While a plurality of hooks may be provided along direction D1 for adjusting the size of the garment, a plurality of hooks may be provided along direction D2 as may be desired for added strength, size of the closure, and the like. While shown examples include one, two, or three hooks along direction D2, more hooks may be provided without limitation (for example, a closure configured to close two sides of a shirt or the top of a large bag may include many spaced apart hooks).

Figure 12:
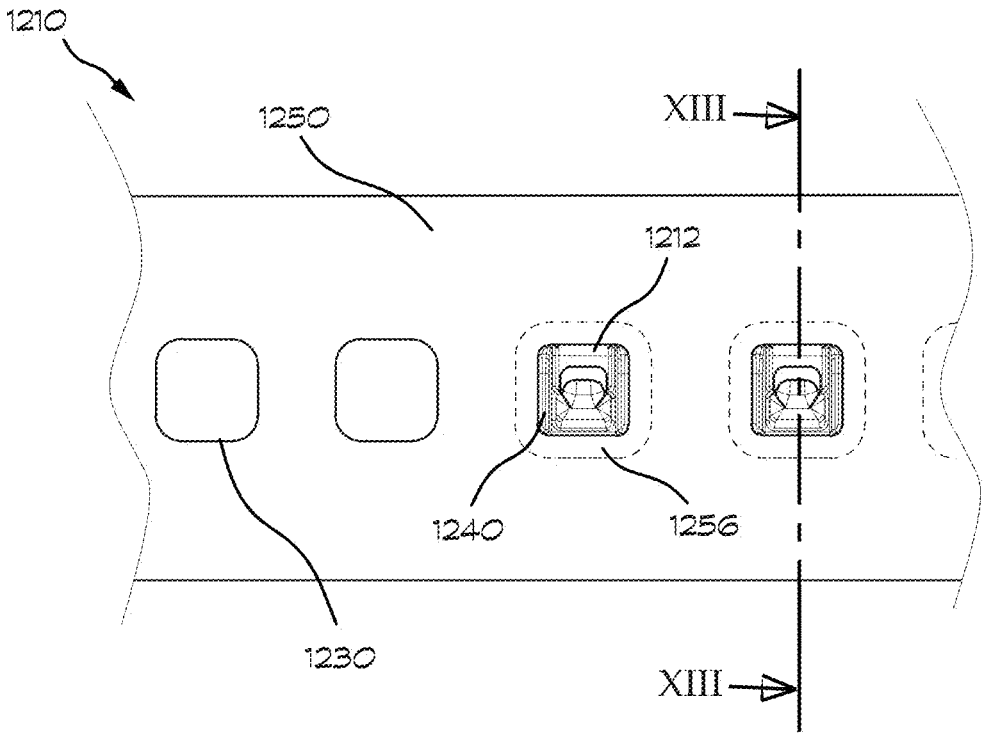
FIG. 12 is a rear elevation view of an exemplary first part of the closure.
Figure 13:
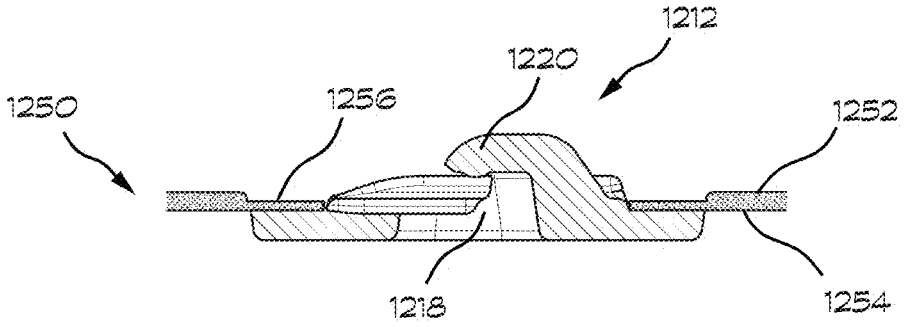
FIG. 13 is an enlarged scale cross-sectional view along the line XIII-XIII of FIG. 12.
Figure 14:
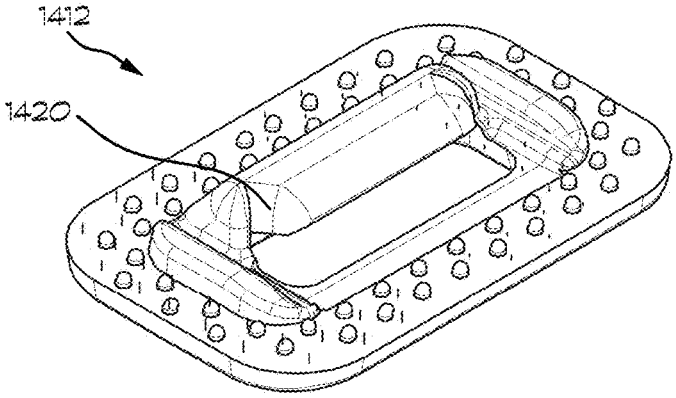
FIG. 14 is a perspective view of a fastener piece of an exemplary closure.
Figure 17:
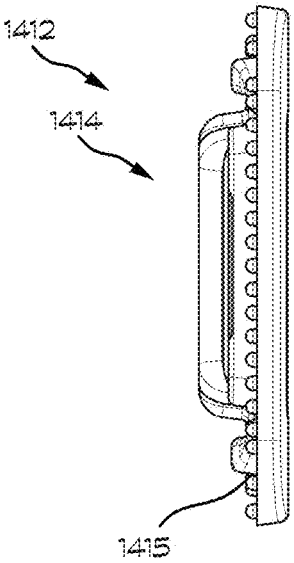
FIG. 17 is a first side view of the first part of FIG. 14.
Figure 15:
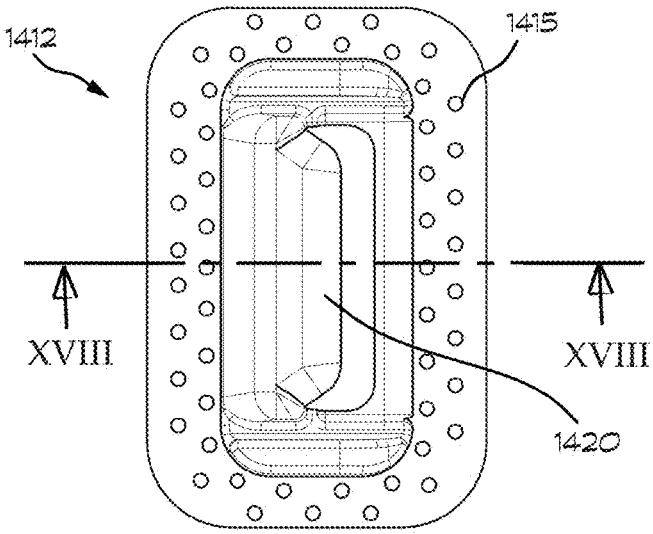
FIG. 15 is a rear elevation view of the first part of FIG. 14.

FIG. 12 is a rear elevation view of an exemplary first part 1210 of the closure. FIG. 13 is an enlarged scale cross-sectional view along the line XIII-XIII of FIG. 12. The first part 1210 may have many features in common with other embodiments described herein, such as the first part 110 of FIG. 1. A method of manufacturing a garment closure may include cutting one or more openings 1230 in a piece of fabric 1250 or similar material. In some cases, the openings may be cut ultrasonically. A fastener piece 1212 may be passed at least partially through one or more of the openings 1230 such that the hook 1220 and the recess 1218 of the fastener piece 1212 are exposed to a first side 1252 of the fabric 1250 and the weld region (see, e.g., FIG. 5) is facing a second side 1254 of the fabric 1250. The anchors 1240 may help align the fastener piece 1212 to the opening 1230. The fastener piece 1212 may then be welded to the fabric 1250 within the weld region 1256 to form a first part 1210 of the garment closure. The width of the weld region may be, for example, 2 mm. This first part may then sewn, welded, or otherwise joined to a garment or the like. A closure part constructed in this manner may have a tensile strength of at least 30 lbs. The arrangement of the hook and anchors on a first side of the fabric with a welding region on the opposing side resists separation of the fastener piece 1212 from the fabric 1250 under high tensile forces.

Figure 18:
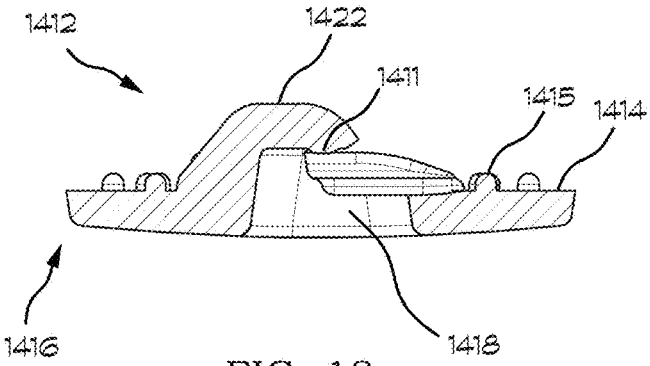
FIG. 18 is a cross-sectional view along the line XVIII-XVIII of FIG. 15.
Figure 16:
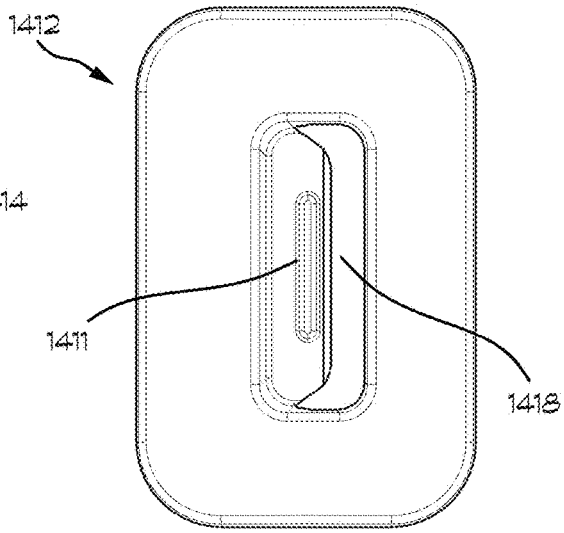
FIG. 16 is a front elevation view of the first part of FIG. 14.

FIGS. 14-17 are, respectively, perspective, rear elevation, front elevation, and first side views of a fastener piece 1412 of another exemplary closure. FIG. 18 is a cross-sectional view along the line XVIII-XVIII of FIG. 15. The fastener piece 1412 may have many features in common with other embodiments described herein, such as the fastener piece 512 of FIG. 5, including a rear face 1414, a plurality of protrusions 1415, a hook 1420 having a roof 1422, and a recess 1418. In general, the shape of the fastener piece 1412 may be well suited for use with a larger fastener than the fastener piece 512. The fastener piece 1412 may also include a lip 1411 on a front side of the hook 1420 that extends perpendicular to the direction of engagement. A complementary second part may have a substantially identical hook and lip, and when the fastener piece 1412 is engaged with such a second part the lips of engaging hooks may abut one another and resist disengaging of the closure (see also lips 411 of FIG. 4). This feature is especially beneficial to resist inadvertent disengagement, such as when the closure is used as a front closure between two brassiere cups, and the cups are moved together in a relaxed position. In some cases, the engagement of the hooks of the two fastener parts may create an audible click as the lips are moved past one another.

Figure 19:
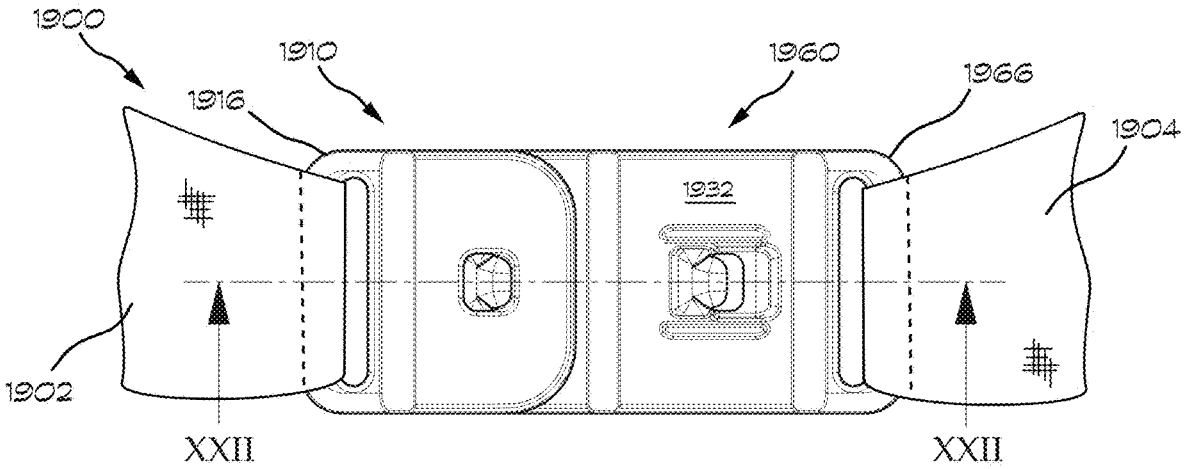
FIG. 19 is a front elevation view of an exemplary closure connected to a garment.

FIG. 19 is a front elevation view of an exemplary closure connected to a garment 1900. The garment 1900 has a first piece 1902 and a second piece 1904 which are connectable via the closure. The first part 1910 of the closure has a first exterior side 1916, and the second part 1960 has a second exterior side 1966. The first piece 1902 of the garment 1900 is connected to the first exterior side 1916 and the second piece 1904 is connected to the second exterior side 1966. In the shown embodiment, pieces 1902 and 1904 are connected, respectively, to the exterior sides 1916 and 1966 of the closure by feeding the fabric of the garment piece through a loop in the exterior side and stitching, or otherwise connecting, the fabric of the garment end to itself (as indicated by the dashed lines). Pieces of the garment may be connected to exterior sides of the closure by other methods well known in the art including simply passing the end through the opening for attachment elsewhere on the garment, as in the case of an adjustable length strap.

Figure 22:
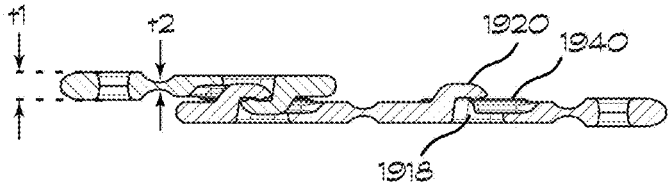
FIG. 22 is a cross-sectional view along the line XXII-XXII of FIG. 19.
Figure 21:
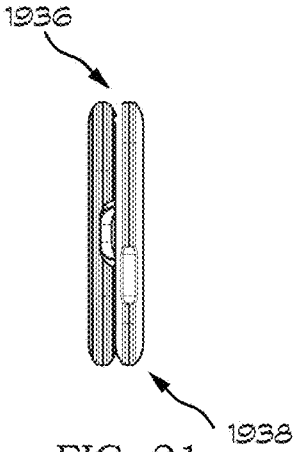
FIG. 21 is a side view of the closure of FIG. 19.
Figure 20:
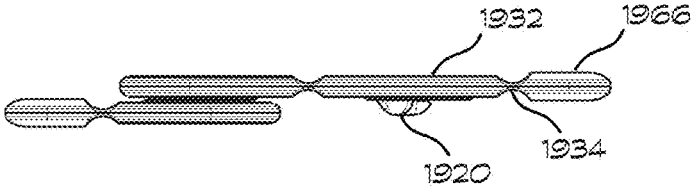
FIG. 20 is an end view of the closure of FIG. 19.

FIGS. 20-22 are end, side, and cross-sectional views, respectively, of the closure of FIG. 19. The closure may have many features in common with other embodiments described herein, such as a hook 1920, a recess 1918, and one or more anchors 1940. Each hook and corresponding recess may be surrounded by a body 1932, and the hook may be unitarily formed with the body. The body may include a waist 1934 having a decreased material thickness relative to the majority of the body. The waist may provide improved flexibility relative to a fastener without a waist, and may permit a greater range of movement of the fastener without decoupling. For example, the body 1932 may have a thickness, t1, and the waist 1934 may have a thickness, t2, that may be less than half of the thickness t1. The waist may extend from a top end 1936 to a bottom end 1938 of the fastener part. More than one waist may be present in a particular fastener piece, for example, each hook 1940 may have an adjacent waist 1934.

Figure 23:
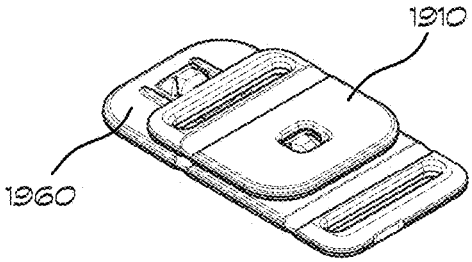
FIG. 23 is a reduced scale perspective view of the closure of FIG. 19 in a first closed position.
Figure 24:
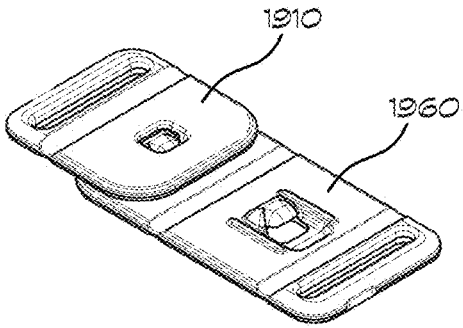
FIG. 24 is a reduced scale perspective view of the closure of FIG. 19 in a second closed position.
Figure 25:
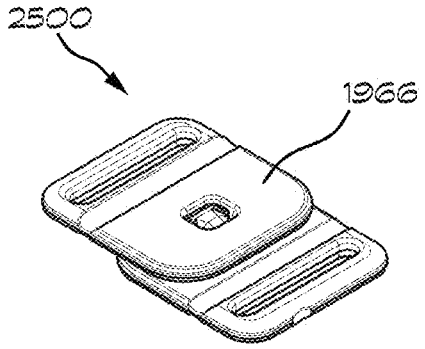
FIG. 25 is a reduced scale perspective view of an exemplary closure.
Figure 26:
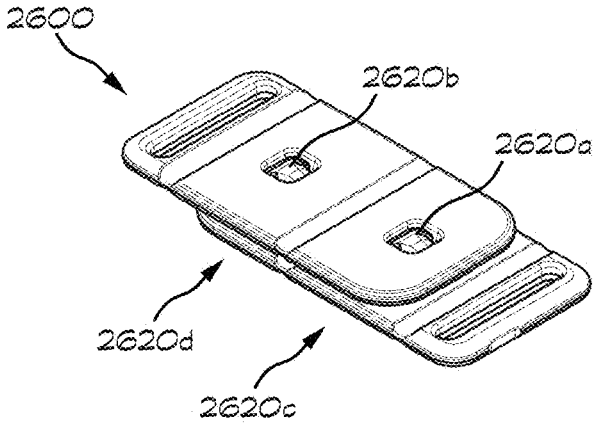
FIG. 26 is a reduced scale perspective view of an exemplary closure.
Figure 27:
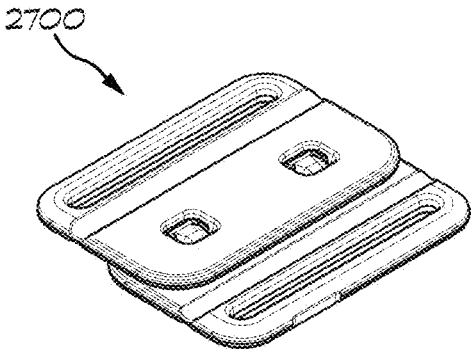
FIG. 27 is a reduced scale perspective view of an exemplary closure.
Figure 28:
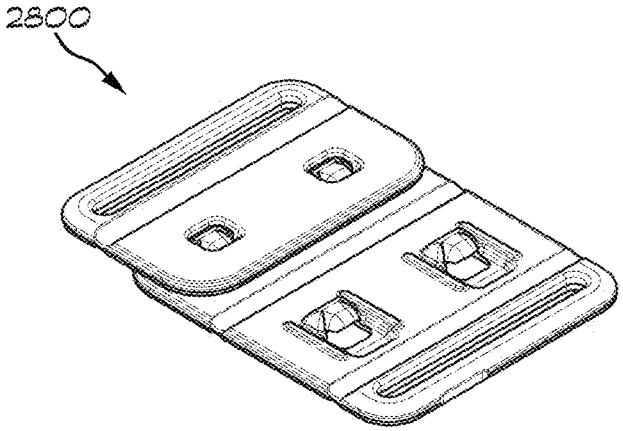
FIG. 28 is a reduced scale perspective view of an exemplary closure.
Figure 29:
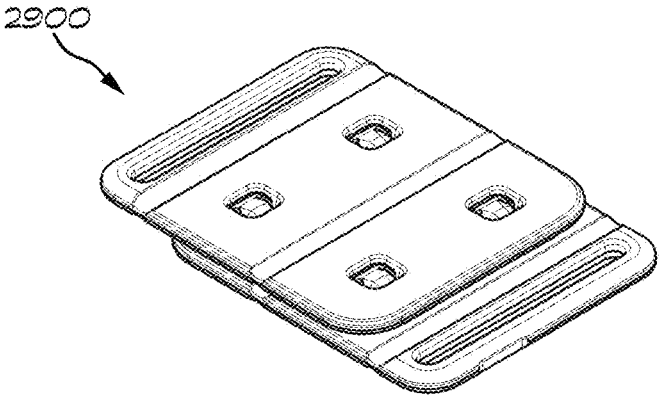
FIG. 29 is a reduced scale perspective view of an exemplary closure.
Figure 33:
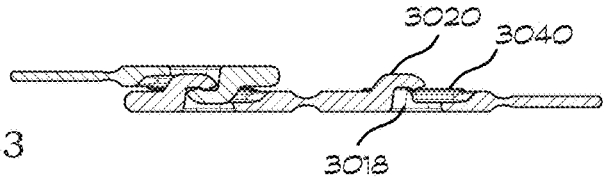
FIG. 33 is a cross-sectional view along the line XXXIII-XXXIII of FIG. 30.

FIGS. 23 and 24 are reduced scale perspective views of the closure of FIG. 19 in alternate closed positions. In the shown example, the first part 1910 has one hook and the second part 1960 has two hooks spaced apart in a direction of garment adjustment. The hook of first part 1910 may alternately be engaged with each hook of the second part 1960, as illustrated. The arrangement of FIG. 23 may achieve a tighter fit for a garment then the arrangement of FIG. 24, thereby providing adjustability to the size of the garment.

FIGS. 25-29 are reduced scale perspective views of other exemplary closures. The closures may have features similar, or identical, to features of other closures described herein, such as the closure of FIG. 19. The closure 2500 includes a first part and a second part each having only one hook. This example closure does not provide adjustment. In this example, the bodies of each of the first part and the second part may be substantially identical. In this sense, the garment closure 2500 is reversible, as it has substantially identical function when oriented in an opposite manner (e.g., whether the first part is oriented toward the wearer or the second part is oriented toward the wearer). In addition, the closure may provide substantially the same appearance when worn in reverse, thus enabling a single garment to worn two different ways. In other cases, a portion or all of one of the parts (e.g., a front face 2542) may have a different style, design, color, or other visual aspect than the other one of the parts. In this case, the body of the parts may still be considered to be substantially identical, as they may have substantially identical shapes and functions.

The closure 2600 includes a first part and a second part each having two hooks spaced apart along a direction of garment adjustment. While the first part and the second part are shown with both hooks of each part engaged with the other part, this need not be the case. For example, the hook 2620*a* of the first part may engage with the hook 2620*d* of the second part to adjust the garment to a larger size. Alternatively, the hook 2620*b* of the first part may engage with the hook 2620*c* of the second part to adjust the garment to a smaller size. The closure 2600 may also have substantially identical parts as described above.

The closure 2700 includes a first part and a second part each having two hooks spaced apart in a direction substantially orthogonal to the direction of garment adjustment. This example closure does not provide adjustment. In this example, the bodies of each of the first part and the second part may be substantially identical as described above.

The closure 2800 includes a first part having two hooks and a second part having four hooks. This closure may provide garment adjustment and additional strength relative to a similar closure having only one hook on the first part. The closure 2900 includes first and second parts each having four hooks, thereby providing adjustment and additional strength. While the foregoing examples illustrate closures having one, two, or four hooks, it will be understood that any number of hooks may be used depending on the desired size, strength, and adjustability of the closure. The body of the first parts and the second parts of these example closures are preferably made out of plastic material, such as polyamide, and the closures may have a tensile strength rating of 30 lbs (about 13.6 kg) or more, which will resist inadvertent opening of the closure.

FIGS. 30-33 are front elevation, end, side, and cross-sectional views, respectively, of another exemplary closure. The closure may have many features in common with other embodiments described herein, such as a hook 3020, a recess 3018, a body 3032 including a waist 3034, and one or more anchors 3040. Each of the first part 3010 and the second part 3060 include a flange 3016 that is configured for a garment, or other piece of material, to be sewn thereto. The flange 3016 may be a thin, substantially planar piece extending away from the body of the part.

Figure 30:
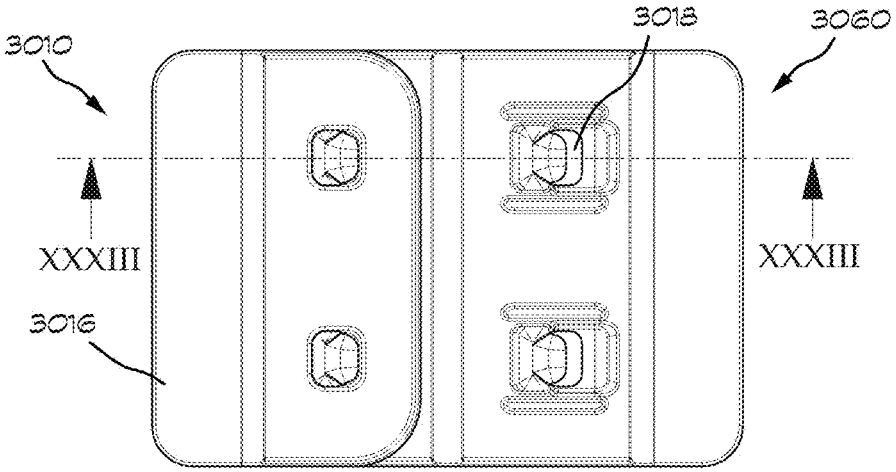
FIG. 30 is a front elevation view of an exemplary closure.
Figure 32:
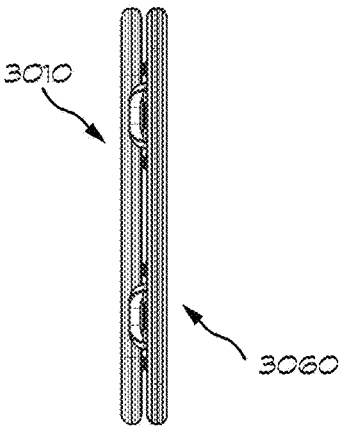
FIG. 32 is a side view of the closure of FIG. 30.
Figure 31:
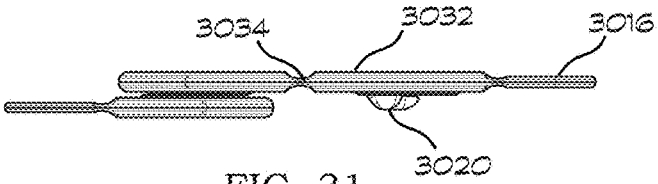
FIG. 31 is an end view of the closure of FIG. 30.
Figure 34:
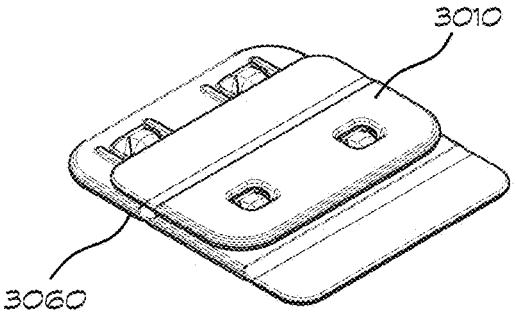
FIG. 34 is a reduced scale perspective view of the closure of FIG. 30 in a first closed position.
Figure 35:
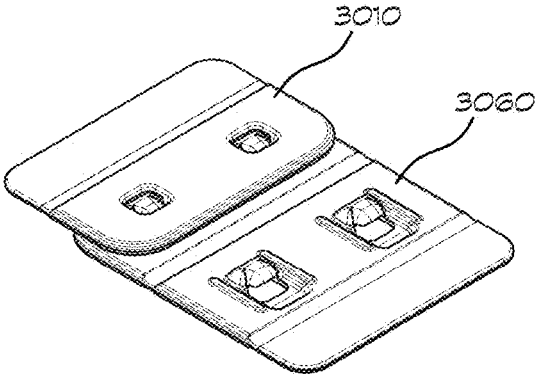
FIG. 35 is a reduced scale perspective view of the closure of FIG. 30 in a second closed position.
Figure 36:
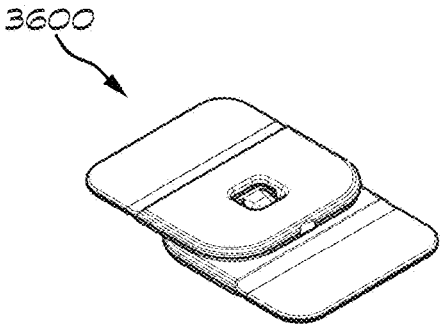
FIG. 36 is a reduced scale perspective view of an exemplary closure.
Figure 37:
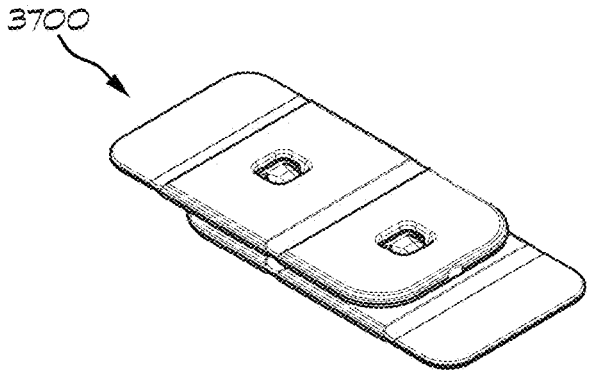
FIG. 37 is a reduced scale perspective view of an exemplary closure.
Figure 38:
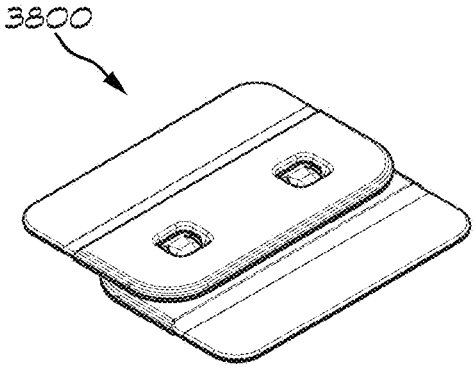
FIG. 38 is a reduced scale perspective view of an exemplary closure.
Figure 39:
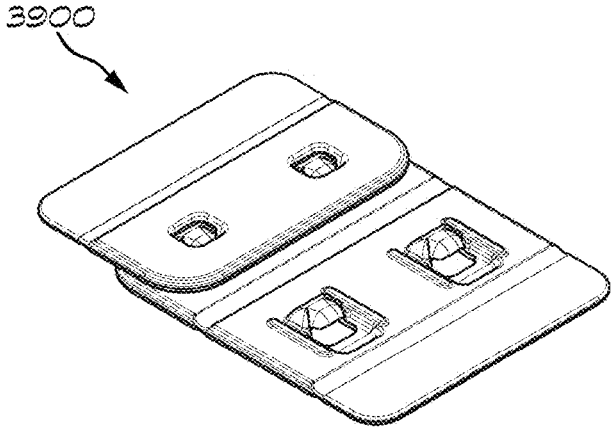
FIG. 39 is a reduced scale perspective view of an exemplary closure.
Figure 40:
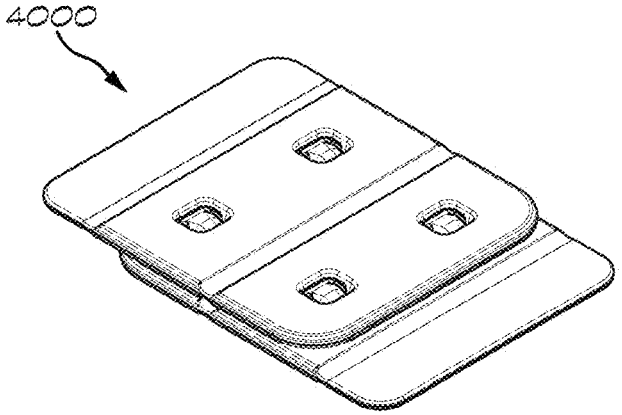
FIG. 40 is a reduced scale perspective view of an exemplary closure.

FIGS. 34 and 35 are reduced scale perspective views of the closure of FIG. 30 in alternate closed positions. The arrangement of FIG. 34 may be used to achieve a tighter fit for a garment then the arrangement of FIG. 35, thereby providing adjustment to the size of the garment.

FIGS. 36-40 are reduced scale perspective view of example closures. The closures 3700, 3800, 3900, and 4000 may have similar features to those discussed with respect to FIGS. 25-29. In particular, these closure may include substantially identical first and second parts, and may provide adjustment to the size of a garment.

Figure 41:
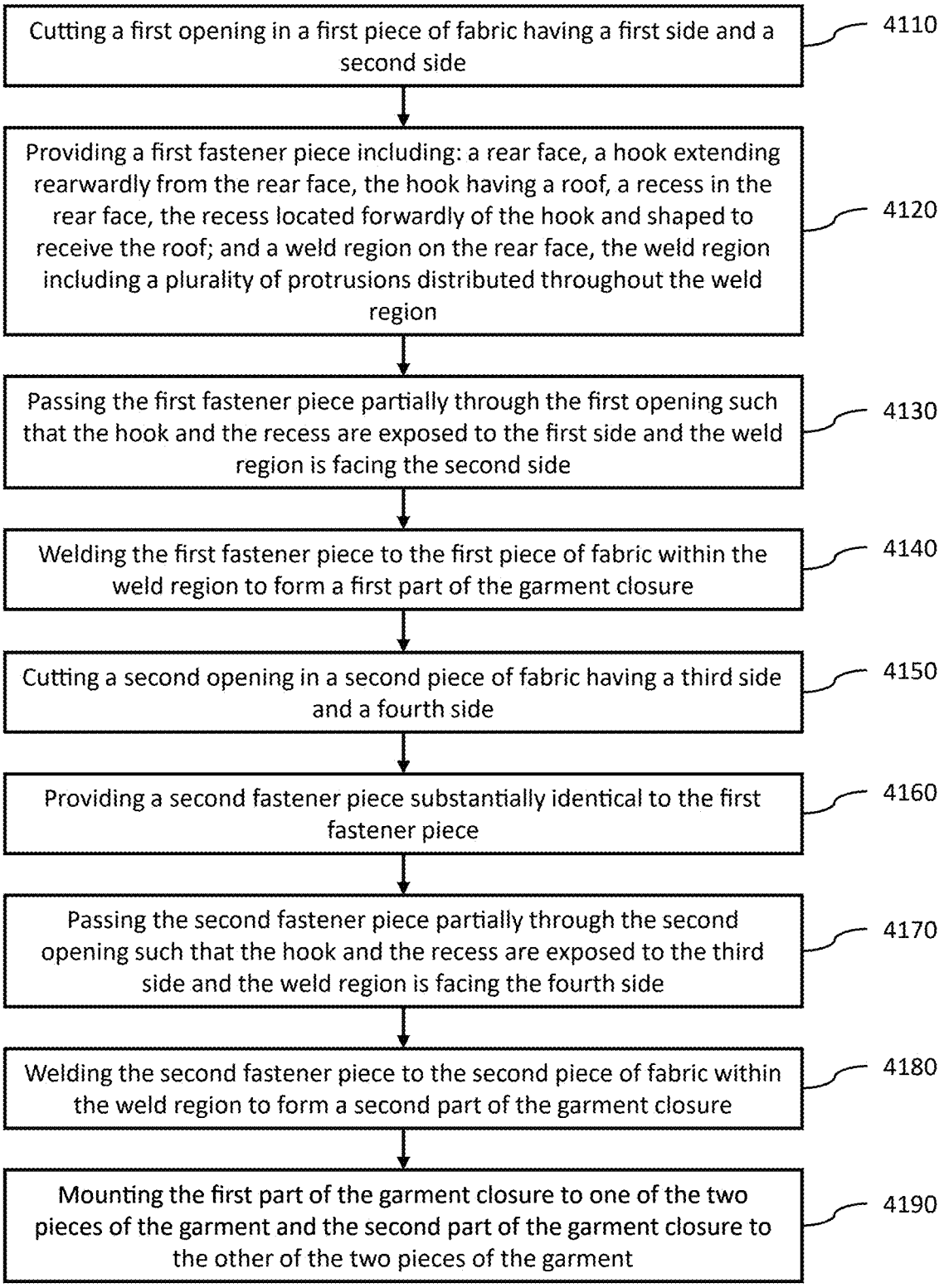
FIG. 41 is a flowchart of an example method of manufacturing a garment closure.

FIG. 41 is a flowchart of an example method of manufacturing a garment closure for securing two pieces of a garment together (refer also to FIGS. 5-13).

Step 4110 includes cutting a first opening (e.g., one or more openings 1230 which may be cut ultrasonically) in a first piece of fabric 1250 having a first side 1252 and a second side 1254.

Step 4120 includes providing a first fastener piece (e.g., fastener piece 512) including: a rear face, a hook extending rearwardly from the rear face, the hook having a roof, a recess in the rear face, the recess located forwardly of the hook and shaped to receive the roof; and a weld region on the rear face, the weld region including a plurality of protrusions distributed throughout the weld region.

Step 4130 includes passing the first fastener piece partially through the first opening such that the hook and the recess are exposed to the first side and the weld region is facing the second side (see, e.g., FIG. 13).

Step 4140 includes welding (e.g., ultrasonically welding) the first fastener piece to the first piece of fabric within the weld region 1256 to form a first part of the garment closure.

Step 4150 includes cutting a second opening in a second piece of fabric having a third side and a fourth side.

Step 4160 includes providing a second fastener piece substantially identical to the first fastener piece.

Step 4170 includes passing the second fastener piece partially through the second opening such that the hook and the recess are exposed to the third side and the weld region is facing the fourth side.

Step 4180 includes welding the second fastener piece to the second piece of fabric within the weld region to form a second part of the garment closure.

Step 4190 includes mounting the first part of the garment closure to one of the two pieces of the garment and the second part of the garment closure to the other of the two pieces of the garment (see, e.g., FIG. 4).

The embodiments of the garment closure described herein are exemplary and numerous modifications, combinations, variations, and rearrangements can be readily envisioned to achieve an equivalent result, all of which are intended to be embraced within the scope of the appended claims. Further, nothing in the above-provided discussions of the garment closure should be construed as limiting the invention to a particular embodiment or combination of embodiments. The scope of the invention is defined by the appended claims.

We claim:

1. A garment closure for securing two pieces of a garment together, the closure comprising:

a first part configured to be mounted on one of the two pieces and a second part configured to be mounted on the other of the two pieces;

each of the first part and the second part comprising:

a fastener piece having a rear face;

a hook extending rearwardly from the rear face and having a roof;

a recess in the rear face, the recess located forwardly of the hook and shaped to receive the roof; and two anchors extending from the rear face, each of the two anchors located adjacent a side of the hook and having a first end extending beyond an interior end of the hook and a second end extending beyond the recess toward an exterior side of the fastener piece; and wherein the hook of the first part is engageable with the hook of the second part with the roof of the hook of the first part at least partially located within the recess of the second part and the roof of the hook of the second part at least partially located within the recess of the first part, thereby securing the two pieces of the garment together.

2. The closure according to claim 1, wherein the fastener piece of each of the first part and the second part are substantially identical.

3. The closure according to claim 1, wherein the hook includes a sidewall at least partially surrounding the recess.

4. The closure according to claim 1, wherein the rear face of each of the first part and the second part has a weld region including a plurality of protrusions distributed throughout the weld region.

5. The closure according to claim 4, further including a fabric layer ultrasonically welded to the weld region.

6. The closure according to claim 5, wherein the closure has a tensile strength of at least 30 pounds.

7. The closure according to claim 1, wherein:

the first part includes a plurality of hooks spaced apart in a direction of garment adjustment; and the hook of the second part is alternately engageable with each of the plurality of hooks to adjust a size of the garment.

8. The closure according to claim 7, wherein the plurality of hooks are separated by regions consisting of one or more fabric layers.

9. The closure according to claim 1, wherein each hook of the first part and the second part includes a lip on a front side of the hook, the lip extending perpendicular to a direction of engagement.

10. The closure according to claim 1, wherein the interior end of each of the hooks is tapered rearwardly.

11. The closure according to claim 1, wherein the exterior side of the fastener piece of each of the first part and the second part includes a loop configured for securing one of the two pieces of the garment thereto.

12. The closure according to claim 1, wherein the exterior side of the fastener piece of each of the first part and the second part includes a flange configured for securing one of the two pieces of the garment thereto.

13. The closure according to claim 1, wherein each hook is surrounded by a body and unitarily formed therewith, the body having a waist having a waist thickness that is less than a body thickness.

14. The closure according to claim 13, wherein the waist thickness is less than one half of the body thickness.

15. The closure according to claim 13, wherein the body is unitarily formed with a plurality of hooks and has a plurality of waists, each waist located adjacent one of the plurality of hooks.

16. A garment including the garment closure of claim 1.

17. A method of manufacturing a garment closure for securing two pieces of a garment together, the method comprising:

cutting a first opening in a first piece of fabric having a first side and a second side;

providing a first fastener piece including:

a rear face;

a hook extending rearwardly from the rear face, the hook having a roof;

a recess in the rear face, the recess located forwardly of the hook and shaped to receive the roof;

two anchors extending from the rear face, each of the two anchors located adjacent a side of the hook and having a first end extending beyond an interior end of the hook and a second end extending beyond the recess toward an exterior side of the first fastener piece; and a weld region on the rear face, the weld region including a plurality of protrusions distributed throughout the weld region;

passing the first fastener piece partially through the first opening such that the hook and the recess are exposed to the first side and the weld region is facing the second side;

welding the first fastener piece to the first piece of fabric within the weld region to form a first part of the garment closure;

cutting a second opening in a second piece of fabric having a third side and a fourth side;

providing a second fastener piece substantially identical to the first fastener piece;

passing the second fastener piece partially through the second opening such that the hook and the recess are exposed to the third side and the weld region is facing the fourth side;

welding the second fastener piece to the second piece of fabric within the weld region to form a second part of the garment closure; and mounting the first part of the garment closure to one of the two pieces of the garment and the second part of the garment closure to the other of the two pieces of the garment.

18. The method of claim 17, wherein the first opening and the second opening are cut ultrasonically.

* * * * *